United States Patent [19]

Åhman

[11] Patent Number: 5,067,325

[45] Date of Patent: Nov. 26, 1991

[54] METHOD AND ARRANGEMENT FOR PUMPING REFRIGERANTS

[75] Inventor: Jan-Olov L. Åhman, Norrtälje, Sweden

[73] Assignee: Clas Ove Olsson, Norrtalje, Sweden

[21] Appl. No.: 543,809

[22] PCT Filed: Jan. 27, 1989

[86] PCT No.: PCT/SE89/00029

§ 371 Date: Jul. 24, 1990

§ 102(e) Date: Jul. 24, 1990

[87] PCT Pub. No.: WO89/07227

PCT Pub. Date: Aug. 10, 1989

[30] Foreign Application Priority Data

Jan. 28, 1988 [SE] Sweden ..... 8800282

[51] Int. Cl.[5] ..... F25B 45/00

[52] U.S. Cl. ..... 62/77; 62/292

[58] Field of Search ..... 62/292, 149, 77

[56] References Cited

U.S. PATENT DOCUMENTS

| | | | |
|---|---|---|---|
| 3,232,070 | 2/1966 | Sparano | 62/77 |
| 3,699,781 | 10/1972 | Taylor | 62/474 |
| 4,261,178 | 4/1981 | Cain | 62/292 |
| 4,363,222 | 12/1982 | Cain | 62/292 |
| 4,476,688 | 10/1984 | Goddard | 62/475 |
| 4,646,527 | 3/1987 | Taylor | 62/474 |
| 4,862,699 | 9/1989 | Lounis | 62/149 X |
| 4,938,031 | 7/1990 | Many et al. | 62/149 |

FOREIGN PATENT DOCUMENTS

| | | |
|---|---|---|
| 3616591 | 11/1987 | Fed. Rep. of Germany . |
| 163777 | 7/1958 | Sweden . |

*Primary Examiner*—William E. Tapolcai

*Attorney, Agent, or Firm*—Ladas & Parry

[57] ABSTRACT

A method and apparatus for enabling refrigerants, preferably freons, to be emptied from refrigeration systems or heat pump systems with the aid of piston compressor pumps when repairing or scrapping such systems. The compressor suction line is connected to one chamber of a heat exchanger and a pressure reduction valve is connected in the suction line upstream of the heat exchanger. The pressure line extending from the compressor passes to an oil separator and then to the other chamber of the heat exchanger. The fall in pressure in the reduction valve and heating of the refrigerant in the heat exchanger causes the refrigerant to be in a gaseous state when reaching the compressor, which is a prerequisite for safe operation of the compressor. The pressure increase achieved in the compressor pump and cooling of the refrigerant in the heat exchanger enables the refrigerant to be delivered to a container, preferably in a liquid state.

12 Claims, 2 Drawing Sheets

METHOD AND ARRANGEMENT FOR PUMPING REFRIGERANTS

TECHNICAL FIELD

The present invention relates to a method and apparatus which will enable the use of a piston compressor pump in pumping preferably refrigerants of low boiling points, either in a liquid or a gaseous state, for instance freons, from a first refrigerant circuit or container to a second refrigerant circuit or container.

BACKGROUND PRIOR ART

The developments of refrigerators and freezer systems have resulted in the extensive use of different types of freons as the refrigerating medium. When repairing and scrapping small refrigerating and freezer systems recovery of the refrigerant has been ignored, since there is no method by means of which the refrigerant can be recovered easily and quickly and at relatively low costs. Instead, these freons have been quite simply released into the atmosphere. In the case of larger systems, attempts have been made, in comparable situations, to recover as much of the refrigerant as possible, with the aid of relatively expensive and unmanageable pistonless compressor pumps.

The recently recognized fact that freons have a harmful effect on the atmospheric protective ozone layer encircling the earth has led to a demand for a reduction in freon emissions into the atmosphere. This demand has led to the development of freon suction devices, or freon-exhausters, based on the use of piston compressors of the kind which are mass produced in large numbers, and therewith at relatively small costs, for use in conjunction with compressor driven refrigerators and freezers. These freon suction devices, however, are only suitable for extracting freon in gaseous form, since liquid freon cannot be compressed and consequently the compressor will be seriously damaged if liquid freon should enter a working piston compressor. Consequently, when emptying such refrigerating systems, which contain freon in both a liquid and a gaseous state in different parts of the system, it is recommended that the system is emptied from the gas side and that the liquid freon is permitted to pass to a gaseous state in the system during the process of emptying the system. Such an emptying process will take a long time to complete, however, and is not entirely safe, since there is always a risk that liquid freon will enter the pump and cause serious pump damage.

SUMMARY OF THE INVENTION

One object of the invention is to provide a method and apparatus which will enable a refrigerating system to be emptied quickly and safely from both the gas and the liquid side thereof. Another object is to provide less costly, readily handled and readily transported freon suction devices, by enabling such devices to be constructed with the aid of known, mass produced components. These objects are achieved in accordance with the invention by means of an inventive method and arrangement having the characteristic features set forth in the following detailed description.

BRIEF DESCRIPTION OF THE DRAWING

The invention will now be described in more detail with reference to the accompanying drawing, in which.

DETAILED DESCRIPTION OF A PREFERRED EMBODIMENT

Figure 1:
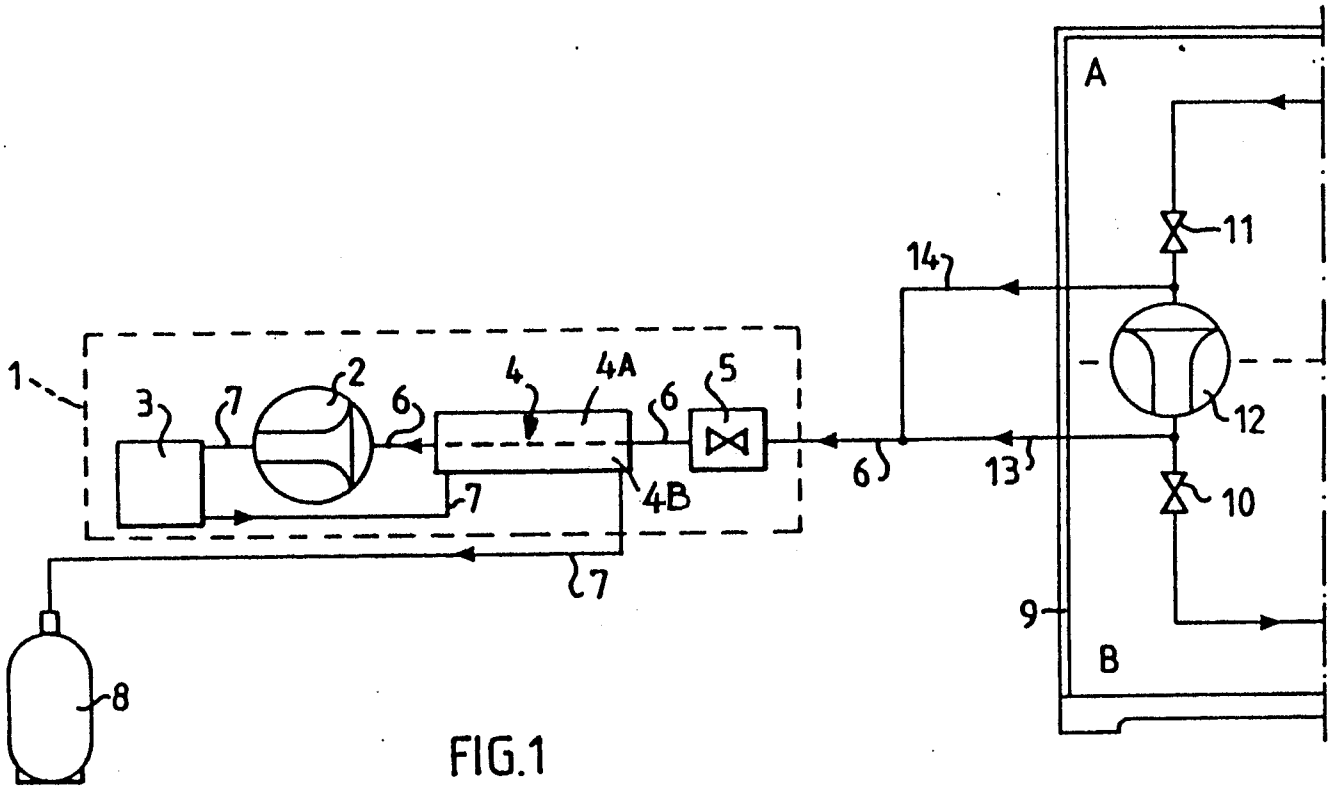
FIG. 1 illustrates schematically an inventive method of pumping refrigerant from a refrigerating system to a container with the aid of a piston compressor pump.

FIG. 1 illustrates schematically the inventive method of pumping refrigerant, e.g. freon, from a refrigerating plant or system 9, only part of which is shown, to a container 8, and the reference numeral 1 in said Figure identifies a broken line surrounding a pump arrangement which includes those components necessary for carrying out the method. In addition to a piston compressor pump 2 and an oil separator 3 associated therewith, these components also include a heat exchanger 4 which is provided with two chambers or pipe systems, 4A, 4B and a pressure reduction valve 5. One chamber 4A of the heat exchanger 4 is connected in the pipe or line through which refrigerant is delivered to the compressor 2, i.e. the suction line 6, at a location close to the compressor, and the pressure reduction valve 5 is connected to the line 6 at a location upstream of the compressor as seen in the direction of refrigerant flow to the compressor. The pipe or line extending from the compressor 2, i.e. the pressure line 7, first passes through the oil separator 3, in which any oil present in the refrigerant and picked up from the compressor is separated from the refrigerant and returned to the compressor. The refrigerant is then passed to the other chamber 4B of the heat exchanger 4, before it can be connected to a collecting container or cylinder 8.

The refrigerating plant 9, of which only part is shown and the operating principles of which are known, includes a cooling compressor 12 which has a respective closure valve 10, 11 mounted on the suction and pressure side thereof. With respect to the preferred state of the refrigerant in the refrigerating system of the plant 9, the refrigerating system can be divided into a gas side and a liquid side, with the compressor 12 and a system expansion valve (not shown) being arranged in the zones between said gas and liquid sides. The gas side is designated A and the liquid side B and a broken line through the compressor 12 marks an imaginary boundary between these sides. For the purpose of transferring refrigerant to the container 8, the suction line 6 of the pump arrangement 1 is connected to both the gas side A and the liquid side B of the refrigerating plant 9 by means of two branch lines 13 and 14. The refrigerating system can therewith be emptied of refrigerant either from solely the gas side A or solely the liquid side B or from both side A and side B simultaneously, by adjusting the settings of valves 10 and 11 accordingly. When the system is emptied from the B-side, the refrigerant will arrive at the reduction valve 5 preferably under pressure and in a liquid state and a greater part of the refrigerant will be converted to gas form in the pressure reduction valve 5. The refrigerant then passes through chamber 4A of the heat exchanger 4, which operates in accordance with the counterflow principle and in which any liquid refrigerant in the refrigerant flow will be progressively heated and thereby gasified. The refrigerant entering the compressor 2 is thus in a gaseous state and is compressed in the compressor and then passed to the oil separator 3, in which any oil present in the refrigerant is removed therefrom, whereafter the refrigerant is passed under pressure to the chamber 4B of the heat exchanger 4, where it is progressively cooled to a liquid state such as to enable it to be fed into the container or cylinder 8. Thus, the refrigerant cooled by pressure reduction in the suction line 6 will be heated in the heat exchanger 4 by the refrigerant heated by compression in the pressure line at the same time as the refrigerant in the pressure line 7 is cooled by the medium in the suction line 6.

Figure 2:
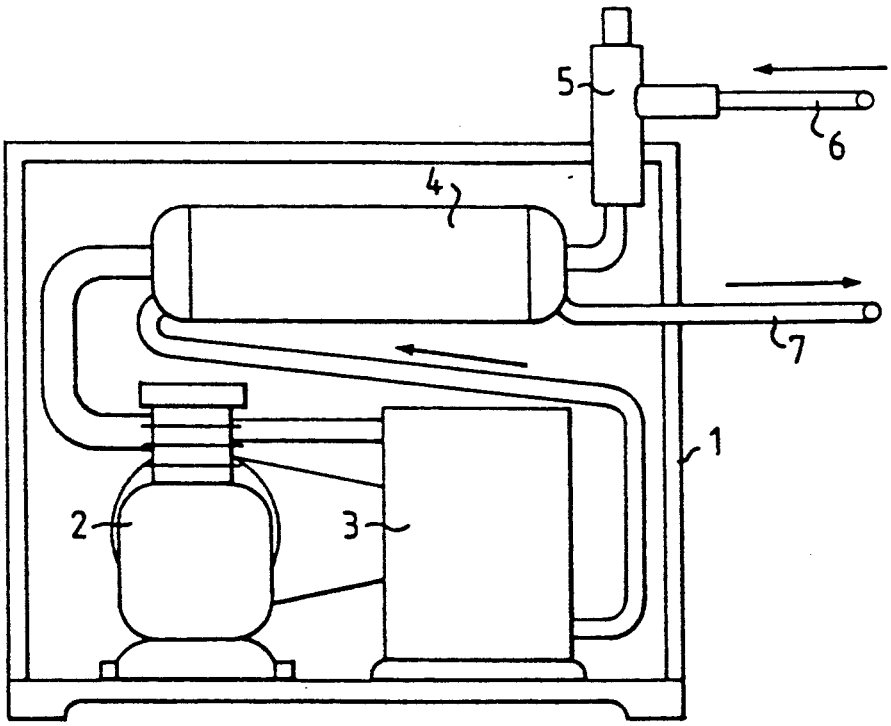
FIG. 2 is a side view which illustrates schematically alternative positioning of the main components of the inventive arrangement.

FIG. 2 is a side view which illustrates schematically an alternative positioning of the main components of an inventive pump arrangement enclosed in a casing 1. The pump arrangement includes compressor 2, pressure reduction valve 5, heat exchanger 4 and oil separator 3; gaseous or liquid refrigerants arriving in the suction line 6 in the direction of the arrow will first pass through the valve 5 and then through one chamber of the heat exchanger 4 and will enter the compressor 2 in a gaseous state. When the refrigerant leaves the compressor, in which the pressure of the refrigerant is increased, the refrigerant is passed through the oil separator 3 and from there to the other chamber of the heat exchanger, in which the refrigerant is cooled and preferably leaves the pressure line 7 in a liquid state.

Depending on the various factors involved, such as the boiling point of the medium to be pumped for instance, it may be necessary to supplement the pump arrangement 1 with auxiliary devices, for instance a drying filter on the suction side or a condenser on the pressure side. This latter auxiliary may be necessary when the heat exchanger does not cool the refrigerant adequately. The pressure reduction valve will also preferably be of a kind which can be set to desired pressure drops, so as to enable the pump arrangement to be used optimally with all types of refrigerants.

I claim:

1. A method of recovering refrigerant from a system comprising feeding refrigerant from a system in liquid or gaseous state to a pressure reduction valve, expanding the refrigerant in said valve, passing the refrigerant through a heat exchanger, heating the refrigerant in said heat exchanger such that when the refrigerant is discharged from the heat exchanger, the refrigerant is in a gaseous state, compressing the refrigerant in gaseous state in a compressor, passing the refrigerant from the compressor through said heat exchanger in counterflow with the refrigerant passing through the heat exchanger from the pressure reduction valve, transferring heat from the refrigerant passing through the heat exchanger from the compressor to the refrigerant passing through the heat exchanger from the pressure reduction valve to cool the refrigerant from the compressor and heat the refrigerant from the pressure reduction valve, and discharging the refrigerant from the heat exchanger which came from the compressor.

2. A method as claimed in claim 1, wherein said refrigerant discharged from the heat exchanger is in liquid state, said method further comprising delivering the refrigerant in liquid state to a container.

3. A method as claimed in claim 1, comprising separating oil from the refrigerant coming from the compressor before the refrigerant is passed through the heat exchanger.

4. A method as claimed in claim 1, comprising forming said compressor as a piston compressor pump.

5. A method as claimed in claim 1, said expanding of the refrigerant in said pressure reduction valve causing said refrigerant to be expanded to gaseous state.

6. A method as claimed in claim 1, the compressing of the refrigerant in said compressor and the cooling of the refrigerant in the heat exchanger causing said refrigerant to be discharged in liquid state from the heat exchanger.

7. Apparatus for recovering refrigerant from a system comprising:

pressure reduction valve means having an inlet for receiving refrigerant to reduce the pressure of the refrigerant, heat exchanger means, connected to said pressure reduction means to receive the refrigerant therefrom after the pressure of the refrigerant has been reduced, for heating said refrigerant, such that the refrigerant leaves the heat exchanger means in gaseous state, compressor means for compressing the refrigerant in gaseous state from the heat exchanger means, and means for conveying the refrigerant from the compressor means to the heat exchanger means in counterflow with the refrigerant passing through the heat exchanger means from the pressure reduction valve means to effect heat exchange therewith and cause heating thereof and cooling of said refrigerant coming from the compressor means.

8. Apparatus as claimed in claim 7, comprising a container connected to said heat exchanger means to receive the refrigerant passing therethrough from the compressor means.

9. Apparatus as claimed in claim 7, comprising oil separater means between the compressor means and the heat exchanger means for removing any oil from the refrigerant before it enters the heat exchanger means.

10. Apparatus as claimed in claim 7, wherein said heat exchanger means includes separate chambers for flow of refrigerant coming from the pressure reduction valve means and from the compressor means.

11. Apparatus as claimed in claim 7, wherein said compressor means comprises a piston compressor pump.

12. Apparatus as claimed in claim 7, wherein said compressor means and said heat exchanger means are constituted to produce liquefication of the refrigerant after it has passed through the compressor means and the heat exchanger means.

* * * * *